US006717085B2

(12) United States Patent
Wang

(10) Patent No.: US 6,717,085 B2
(45) Date of Patent: Apr. 6, 2004

(54) PRESS-BUTTON SWITCH

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 169 days.

(21) Appl. No.: 10/095,069

(22) Filed: Mar. 12, 2002

(65) Prior Publication Data

US 2003/0183498 A1 Oct. 2, 2003

(51) Int. Cl.[7] ..... H01H 13/14

(52) U.S. Cl. ..... 200/520; 200/553; 200/5 R; 336/66; 336/37

(58) Field of Search ..... 200/520, 553, 200/519, 5 R; 336/66, 37

(56) References Cited

U.S. PATENT DOCUMENTS 5,262,748 A * 11/1993 Tsung-Mou ..... 337/66

* cited by examiner

*Primary Examiner*—Elvin Enad
*Assistant Examiner*—Jennifer A. Poker
(74) *Attorney, Agent, or Firm*—Rosenberg, Klein & Lee

(57) ABSTRACT

A press-button switch is provided which includes a control unit between a press button and a conductive switching element within a housing of the press-button switch. The control unit utilizes a push element and a hook member beneath the press button to push and pull, respectively, against a first and a second actuating element both of which are situated at different planes. Thus, the rotary body of the control unit can continuously rotate at an angle of 180 degrees in a single direction, and the eccentric hole will change its position between an upper point (H) and a lower point (L) in order to move the push-pull rod for displacing the switching element for the on-off control. Moreover, the press-button switch can be smoothly disconnected in off state for ensuring the electric safety in case of overload current.

2 Claims, 16 Drawing Sheets

PRESS-BUTTON SWITCH

BACKGROUND OF THE INVENTION

1. Field of the Invention

The present invention relates to a press-button switch, and more particularly, to a switch which makes use of a push element and a hook member at the side of the switch to rotate a rotary body in a single direction, thereby causing a push-pull rod to move upwards and downwards in an eccentric way so that the switch can change between on state and off state. In addition, the press-button switch can be smoothly disconnected in off state for ensuring the electric safety in case of overload current.

2. Description of the Prior Art

The kinds of switches are various. The common ones are, for example, seesaw switch, press-button switch, etc. In earlier period, they only have on-off function. In case of overload current, they are not able to be disconnected, thereby causing the electric danger in use. Therefore, a safety switch with automatic shutdown device was developed. The inventor of the present invention owns over ten patents in this field. However, the safety switch in the earlier period is mainly the type of seesaw switch while only few press-button switches are provided with automatic shutdown device due to the restriction of the internal construction.

FIGS. 1(A) and 1(B) show a safety see-saw switch 1 disclosed in Taiwanese Patent No. 320355 by the inventor of the present invention in which the on-off control is performed by the up-and-down movement of the press-button 11. In case of the overload current of the conductive strip 12, an automatic shutoff of the switch is achieved.

Since the press-button switch is more suitable for use in computers and electrical appliances, the press-button switch with automatic shutdown device for overload current began to be developed.

FIGS. 2(A) and 2(B) show a safety press-button switch disclosed in Taiwanese Patent No. 422404. This safety press-button switch includes a housing 21, a press button 22 and an actuating piece 23. The press button 22 and the actuating piece 23 are integrated in a body. The present invention is characterized in that the actuating piece 23 has a heart-like locating groove 24. A terminal 25 at the right side is connected with a metal engaging piece 26 made of double material and provided with an engaging projection 261 in such a way that the interconnection between terminals are achieved. In case of overload current, a great heat is produced and transmitted to the metal engaging piece 26 through the right terminal 25 so that the metal engaging piece 26 is, after being heated, bent to the right side to be separate from engagement. In addition, the press button 22 is raised by means of the main spring 27 in the off state. However, the above-mentioned construction is not optimal, or even inapplicable. As shown in FIG. (B), when the contact points 281, 251 of the middle terminal 28 and the right terminal 25 are in contact with the contact points 291, 292 of the arched seat 29 in lowering the arched seat 27, the overload current is effected upon the middle and right terminals 28, 25 and the arched seat 29, rather than directly upon the metal engaging piece 26. Accordingly, it's too late for the metal engaging piece 26 to be deformed for disconnection when the heat created in case of short circuit is transmitted from the arched seat 29 to the right terminal 25 and further to the metal engaging piece 26, thereby causing the electric danger in use.

Moreover, the aforementioned has to use four contact points 281, 291, 292, 251. In comparison with another switches with two contact points, it's not a practical design.

Referring to FIGS. 3(A), 3(B) and 3(C), a further press-button switch disclosed in the Taiwanese Patent No. 458362 comprises:

a housing 31 being hollow inside and having an opening 311 divided into two operating rooms 313, 314 by a separation member 312, a press button assembly 32 and a conducting assembly 33 being arranged within the operating rooms 313, 314, said conducting assembly 33 being connected with a switching assembly 35; and a coupling mechanism 34 having a press element 341 disposed in the operating area and plugged into a through hole 311 of the separation member 312, a resilient element 342 connected to the press element 341 and the separation member, and a rotary seat 344 pivotably connected to the housing and provided with a guide groove 343 for receiving the press element 341 in the rotary seat 344, said rotary seat 344 further having a locating part 345 in connection with the switching assembly 35.

Based upon the above-mentioned, the press element 341 is pressed downwards by the press button assembly 32, and the resilient element 342 is compressed so that the other end of the press element 341 is pressed against the guide groove 343 in such a way that the rotary seat 344 is deflected to move the switching assembly 35 and to enable the conducting assembly 33 in connection state. Besides, the press button assembly 32 and the press element 341 restores itself back to its original position by means of the resilient element 342 so that a press-button switch is created.

However, the upper part (I) of the above-mentioned configuration is formed as a conventional press-button switch while the lower part (II) thereof is formed as a conventional seesaw switch. This is only an improvement of Taiwanese Patent No. 83365 (U.S. Pat. No. 5,262,748). Based upon the U.S. Pat. No. 5,262,748, the press button assembly 32 is added to the top of the housing 31 while the rotary seat 344 is the see-saw press button of U.S. Pat. No. 5,262,748. Accordingly, the Taiwanese Patent No. 458362 has a too complicated construction so that the assembly is difficult and its cost is high. Moreover, too many components lead to a high malfunction rate. Consequently, it's applicable, but not perfect and practical.

SUMMARY OF THE INVENTION

It is a primary object of the present invention to remove the above-mentioned drawbacks of the conventional press-button switch and to provide a press-button switch which has simple components so that it's easy for assembly.

It is another object of the present invention to provide a press-button switch which has low production cost and malfunction rate.

It is a further object of the present invention to provide a press-button switch which has the automatic shutoff function in case of overload current for ensuring the electric safety.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1A:
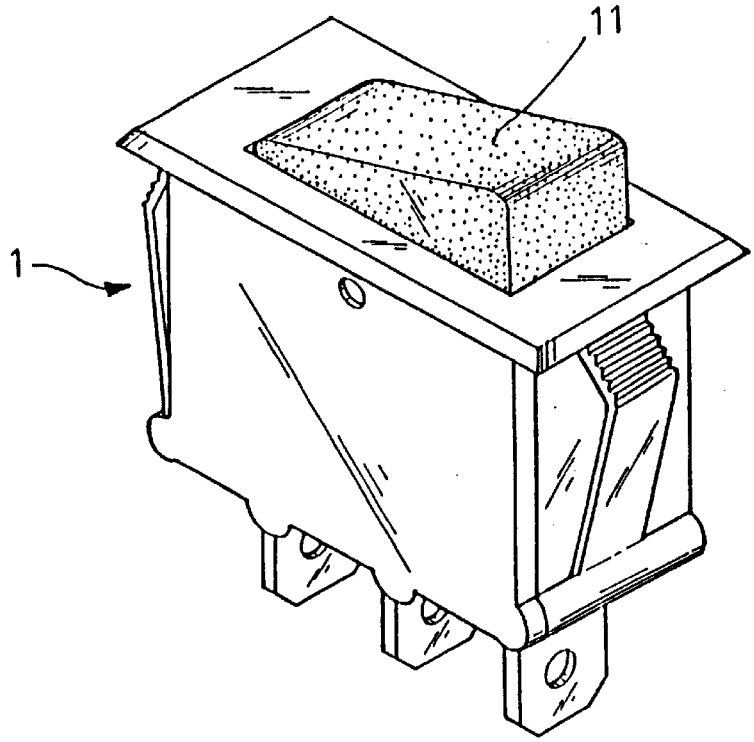
PRIOR ART FIG.1(A)
FIG. 1(A) is a perspective view of a conventional seesaw switch.

First of all, referring to FIGS. 4 through 7, a preferred embodiment of the press-button switch in accordance with the present invention includes a housing 4, at least two connecting terminals 6 and a control unit 8.

The housing 4 is formed in a hollow body and open at one side thereof. The open side of the housing 4 is covered by a side plate 41. An opening 42 is disposed at the top of the housing 4 so that a press button 5 is fitted thereinto. In addition, resilient elements 51 are provided for restoring the press button 5 back to its original position.

The connecting terminals 6 are fitted into the housing 4 and arranged at the bottom thereof. Moreover, a switching element 7 is provided to perform an on-off control of the connecting terminals 6.

The control unit 8 is installed within the housing 4 and controlled by the press button 5 to perform the on-off control of the switch by means of the switching element 7. Furthermore, the control unit 8 includes a rotary body 81 and a push-pull rod 84.

The rotary body 81 has a rotary shaft 811 fitted into a through hole 43 at the inner side of the housing 4 so that the rotary body 81 is located within the housing 4 in rotatable state. In addition, the rotary body 81 further includes a first actuating element 82 and a second actuating element 83 both of which intersects in a cross shape. Besides, the second actuating element 83 is interposed between the rotary body 81 and the first actuating element 82. Moreover, the rotary body 81 has an eccentric hole 812 at the outside face thereof.

The push-pull rod 84 includes a top arm 841 and a bottom member 842. The top arm 841 is rotatably arranged in the eccentric hole 812 of the rotary body 81 while the bottom member 842 is formed in U-shape and a front projection 71 of the switching element 7 is connected (not fixed) to the indentation of the bottom member 842.

Furthermore, the first and second actuating elements 82, 83 are controlled by a push element 52 and a hook member 53 both of which are coupled with the press button 5. The push element 52 is disposed at the top of the first actuating element 82. When the press button 5 is pressed downward, the first actuating element 82 is pushed to turn the rotary body 81. And the hook member 53 is arranged to the side of the second actuating element 83. When the press button 5 is raised back to the original position, the second actuating element 83 will be pulled to enable the rotary body 81 to continuously rotate in the turning direction driven by the first actuating element 82. Accordingly, the rotary body 81 approximately rotates at an angle of 180 degrees in pressing the press button 5 once so that the eccentric hole 812 moves the push-pull rod 84 upwards or downwards. Thus, the switching element 7 is able to perform the on-off control.

Figure 6:
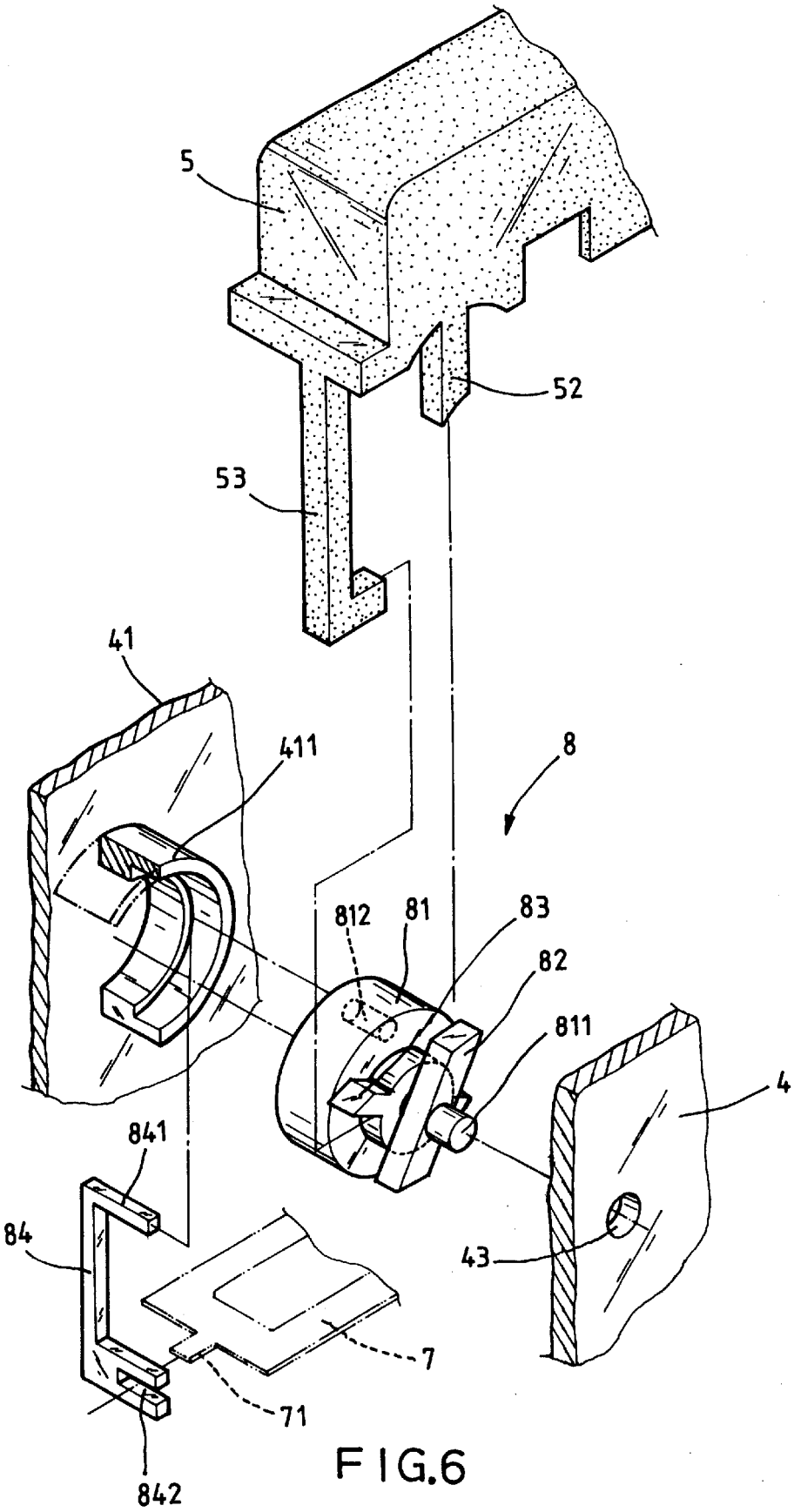
FIG. 6 is a perspective exploded view of the main components of the present invention.
Figure 7:
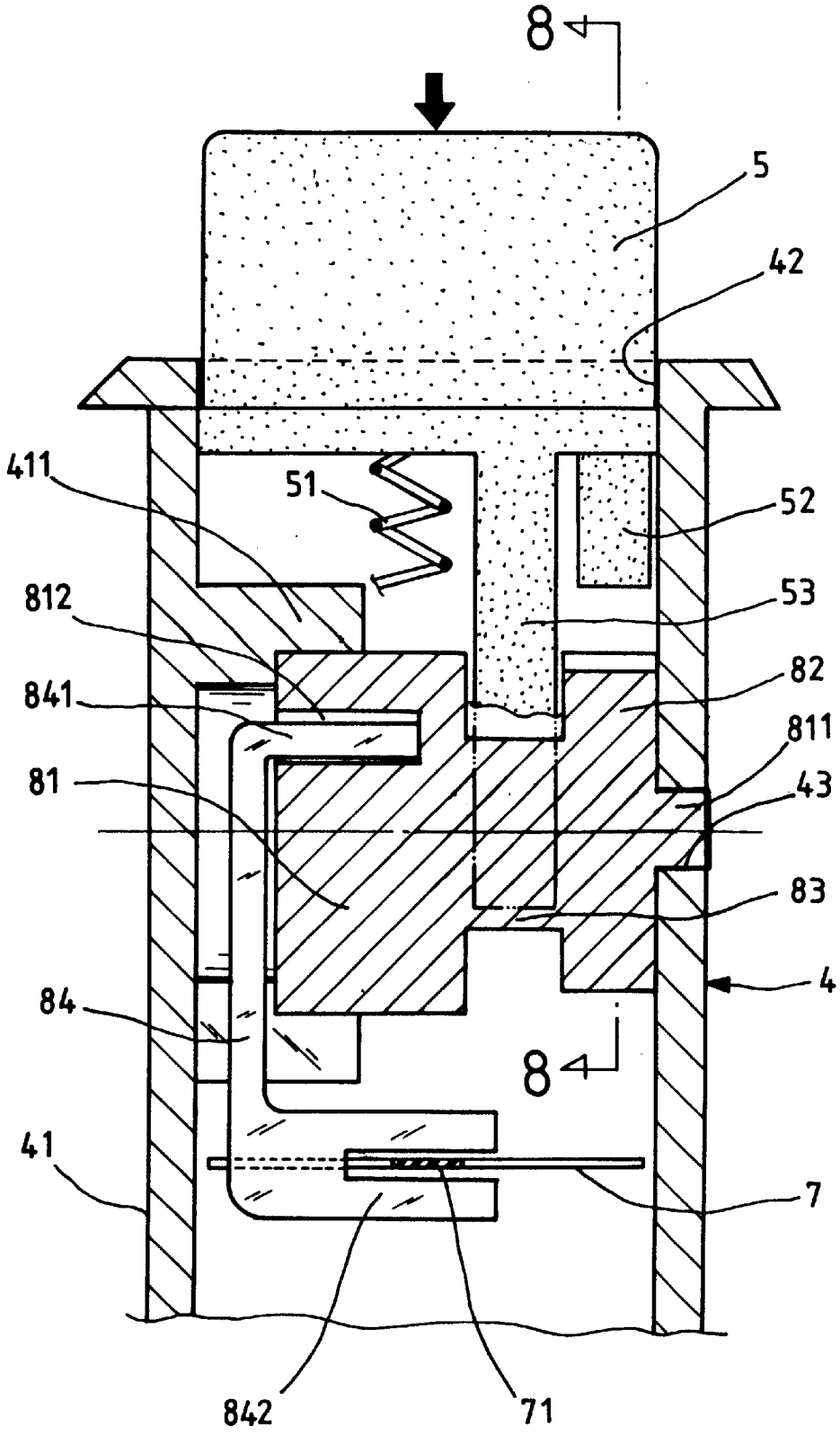
FIG. 7 is a side section of the main components of the present invention.

In order to stabilize the rotation of the rotary body 81 on the rotary shaft 811 within the through hole 43 of the housing 4, a C-shaped fixing seat 411, as shown in FIGS. 6 and 7, is fitted to the inside face of the side plate 41 for receiving the rotary body 81. The opening of the C-shaped fixing seat 411 is made in such a way that the push-pull rod 84 can extend in the outer side to bring the switching element 7 in motion.

Figure 3A:
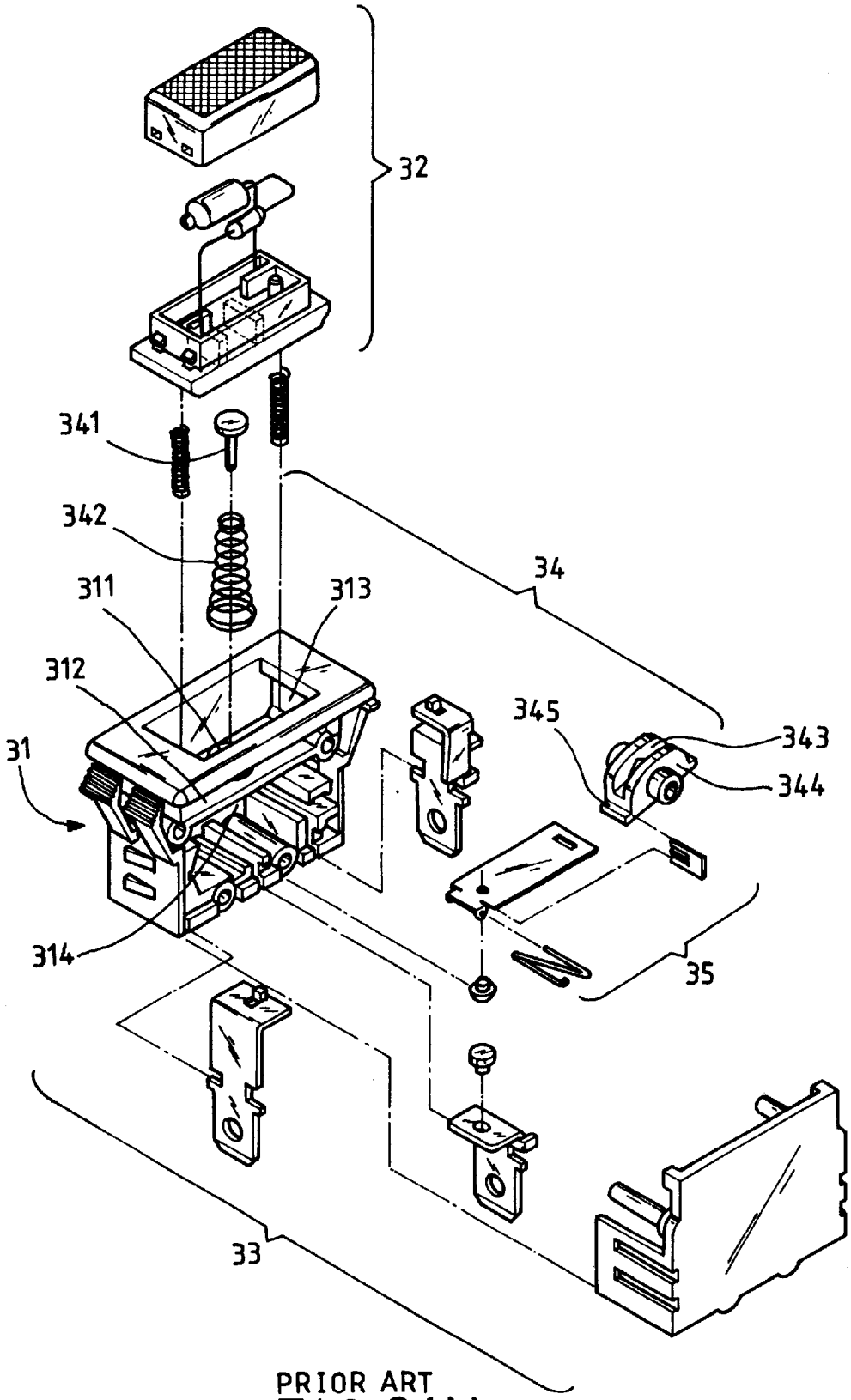
PRIOR ART FIG. 3(A)
FIG. 3(A) is a perspective exploded view of another conventional press-button switch.
Figure 3B:
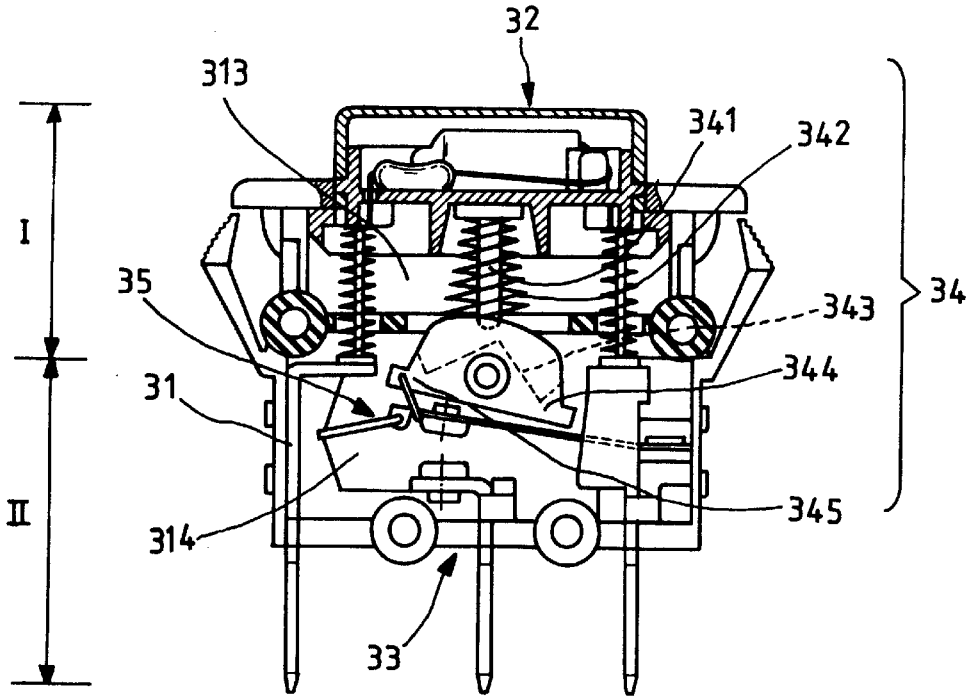
PRIOR ART FIG. 3(B)
FIG. 3(B) is a sectional view of FIG. 3(A) after assembly.
Figure 3C:
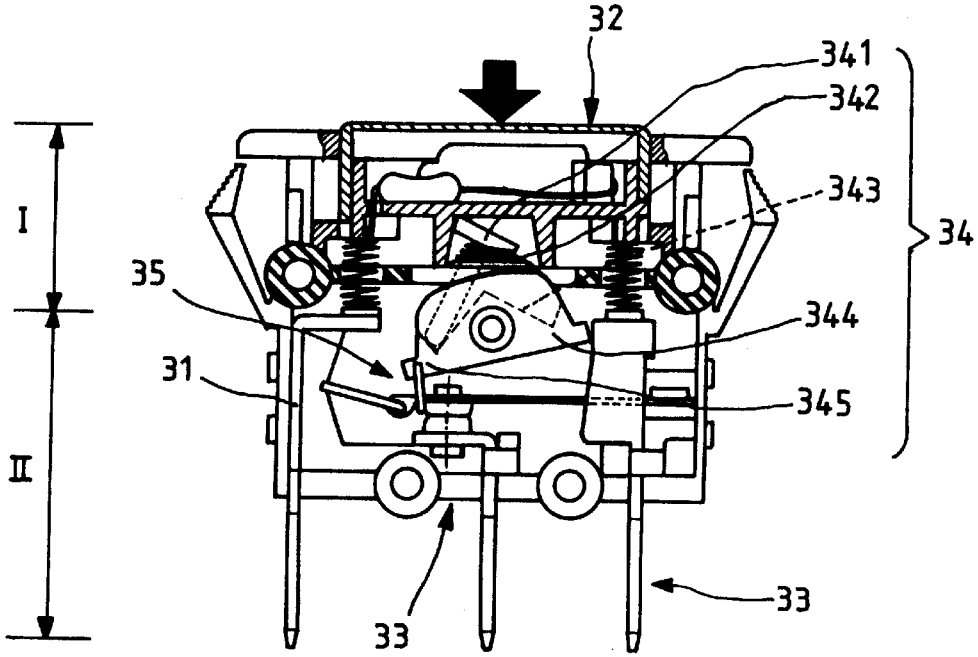
PRIOR ART FIG. 3(C)
FIG. 3(C) is a sectional view of FIG. 3(A), showing that the press button assembly is pressed downward.
Figure 4:
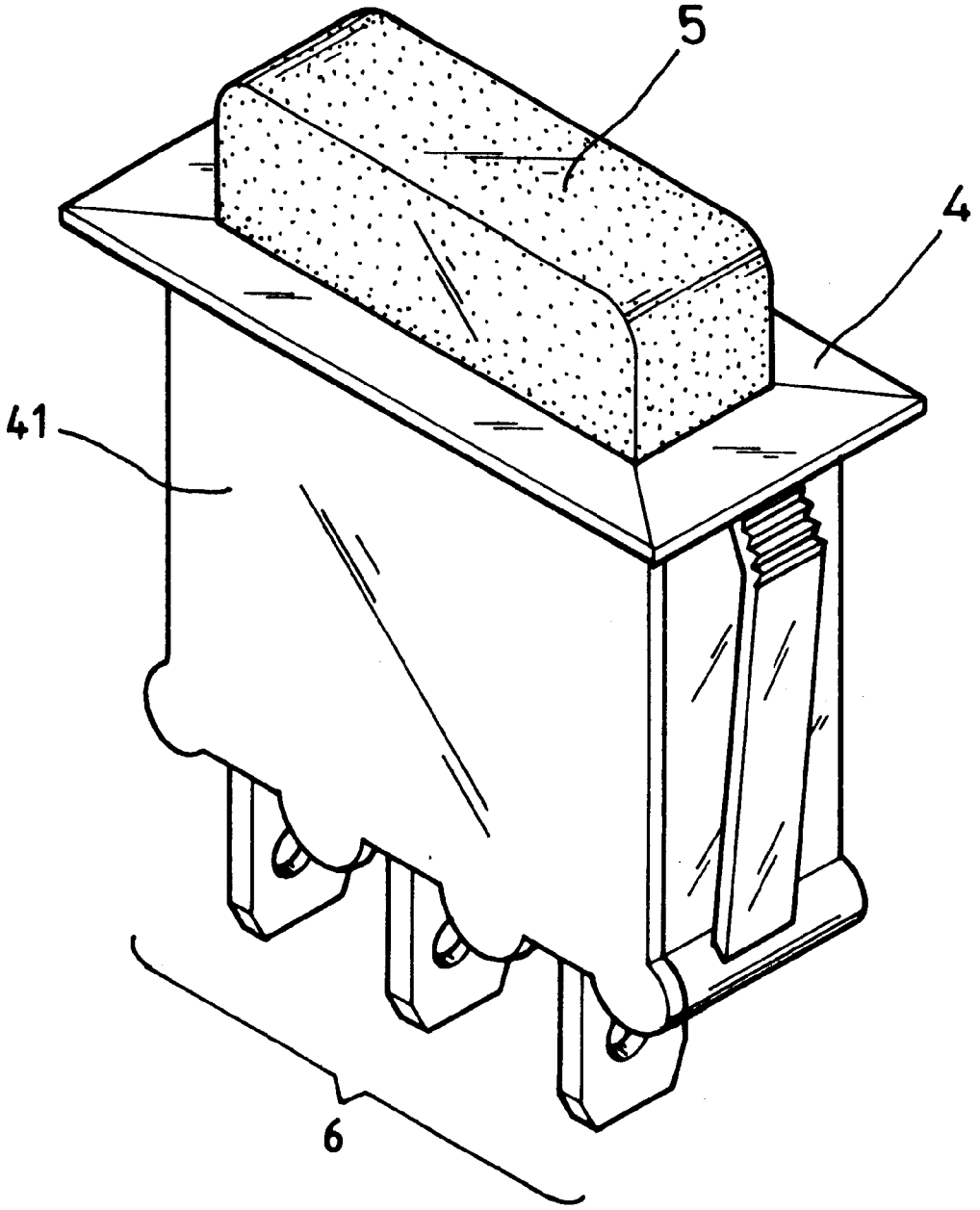
FIG. 4 is a perspective view of the present invention.
Figure 5:
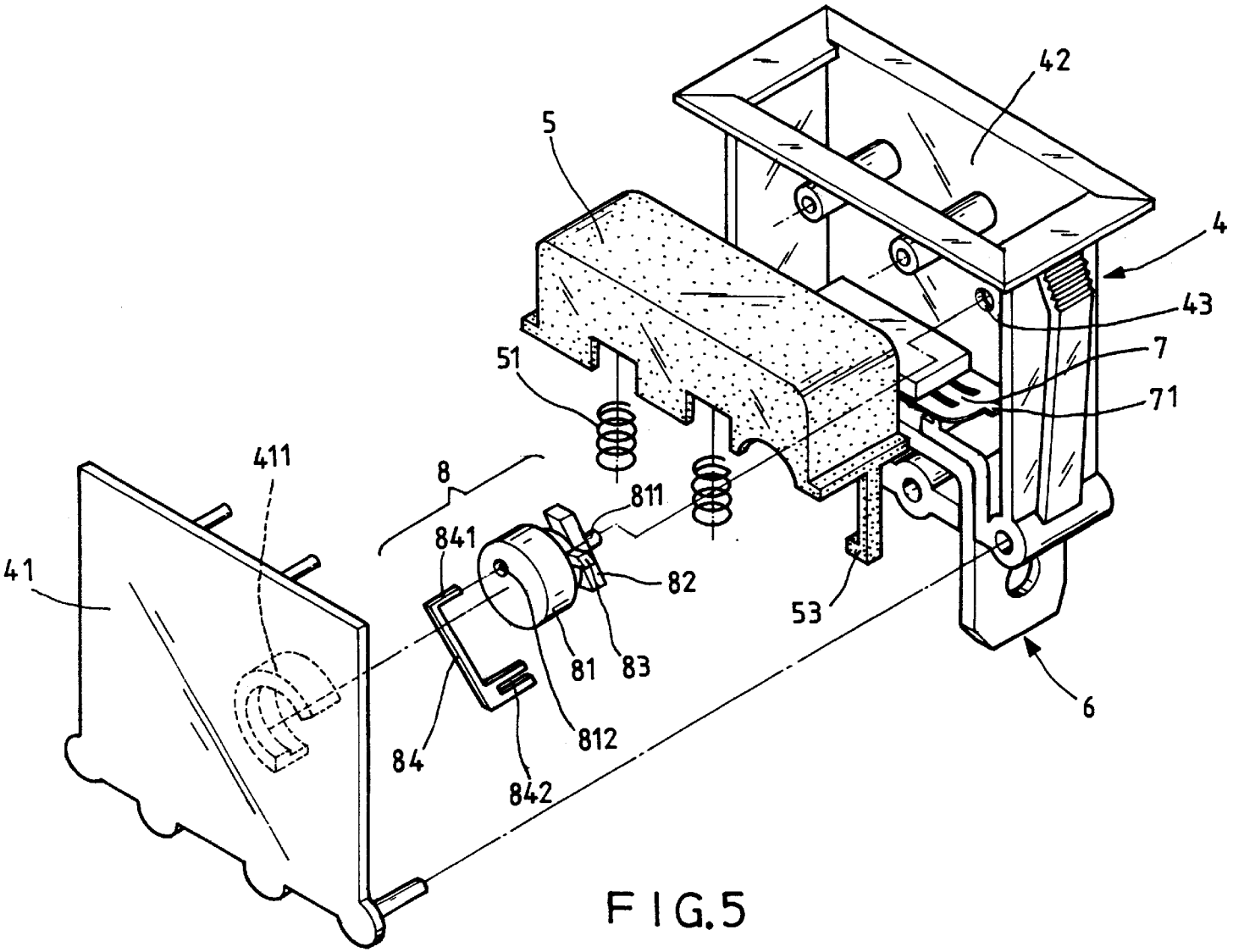
FIG. 5 is a perspective exploded view of the present invention.
Figure 8:
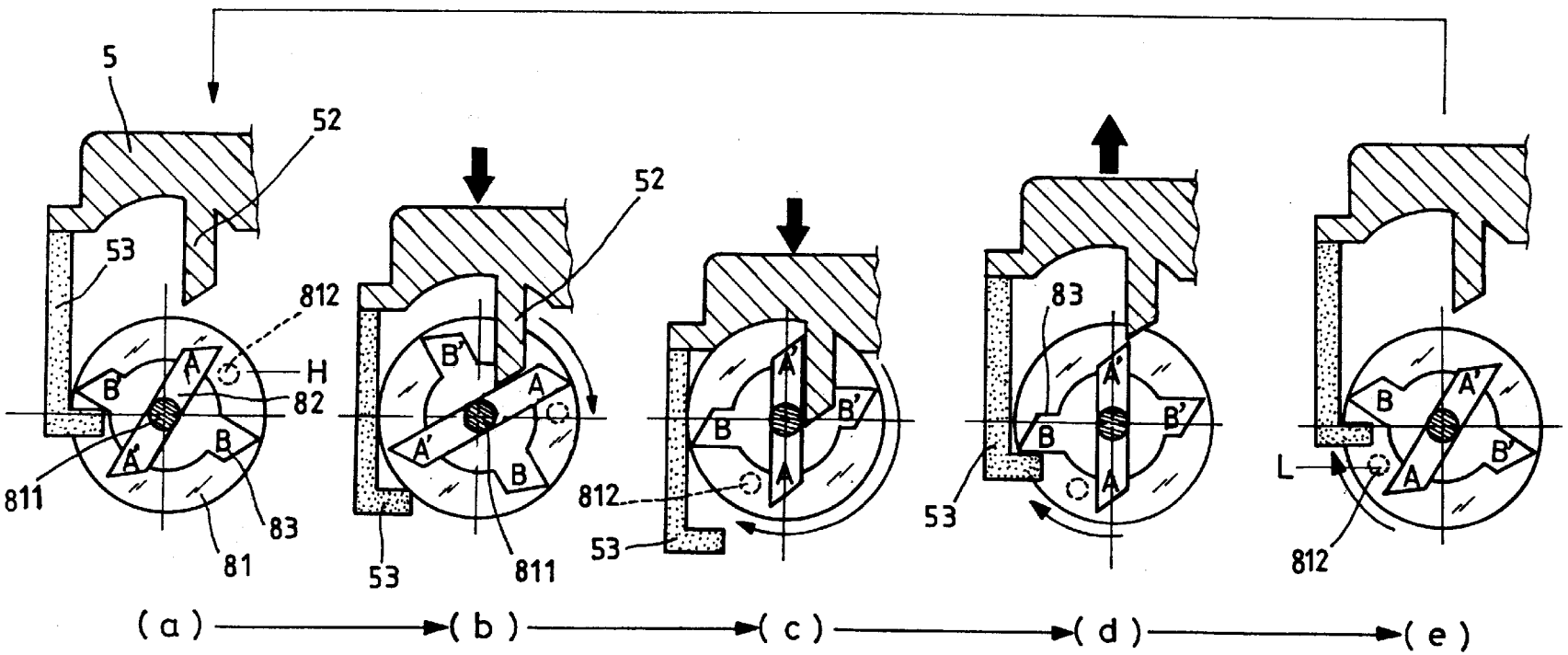
FIG. 8 is a sectional view taken along the line 8—8 of FIG. 1, showing the compressing procedure thereof.

FIG. 8 shows that a complete rotational cycle of the rotary body 81 is created when the press button 5 is pressed once while the movement of the first and second actuating elements 82, 83 are clearly illustrated. FIG. 8 is a sectional view taken along the line 8—8 in FIG. 7 from the rear side of the present invention. FIG. 8(*a*) shows that the press button 5 in an ordinary state is situated within the opening 42 of the housing 4, as shown in FIG. 7. The push element 52 is located slightly above the first actuating element 82 without contact with the A-point thereof while the hook member 53 is situated beneath the B-point of the second actuating element 83. FIG. 8(*b*) shows that the press button 5 is pressed downward and the push element 52 pushes against the A-point of the first actuating element 82 so that the rotary body 81 rotates on the rotary shaft 811. When the press button 5 is pressed downward until the bottom starting point, as shown in FIG. 3(*c*), the A-point of the first actuating element 82 is brought to the position of six o'clock. In releasing the finger, the press button 5 is popped up by means of the resilient elements 51, as shown in FIG. 7 while the hook member 53 pulls against the B-point of the second actuating element 83, as shown in FIG. 8(*d*). When the press button 5 is brought back to the top starting point, the hook member 53 brings the B-point of the second actuating element 83 back to the position, as shown in FIG. 8(*e*). In comparison with the FIGS. 8(*a*) and (*e*), the control unit 8 rotates at the angle of 180 degrees when the press button 5 is pushed downward once. Meanwhile, both ends (A, A', B, B') of the first and second actuating elements 82, 83 are reversely changed. Moreover, the eccentric hole 812 of the rotary body 81 is changed from the H-point of two o'clock to the L-point of the eight o'clock. At this time, the points A' and B' of the first and second actuating elements 82, 83 are brought back to the position in FIG. 8(*a*) while the eccentric hole 812 restores itself to the H-point.

Figure 9:
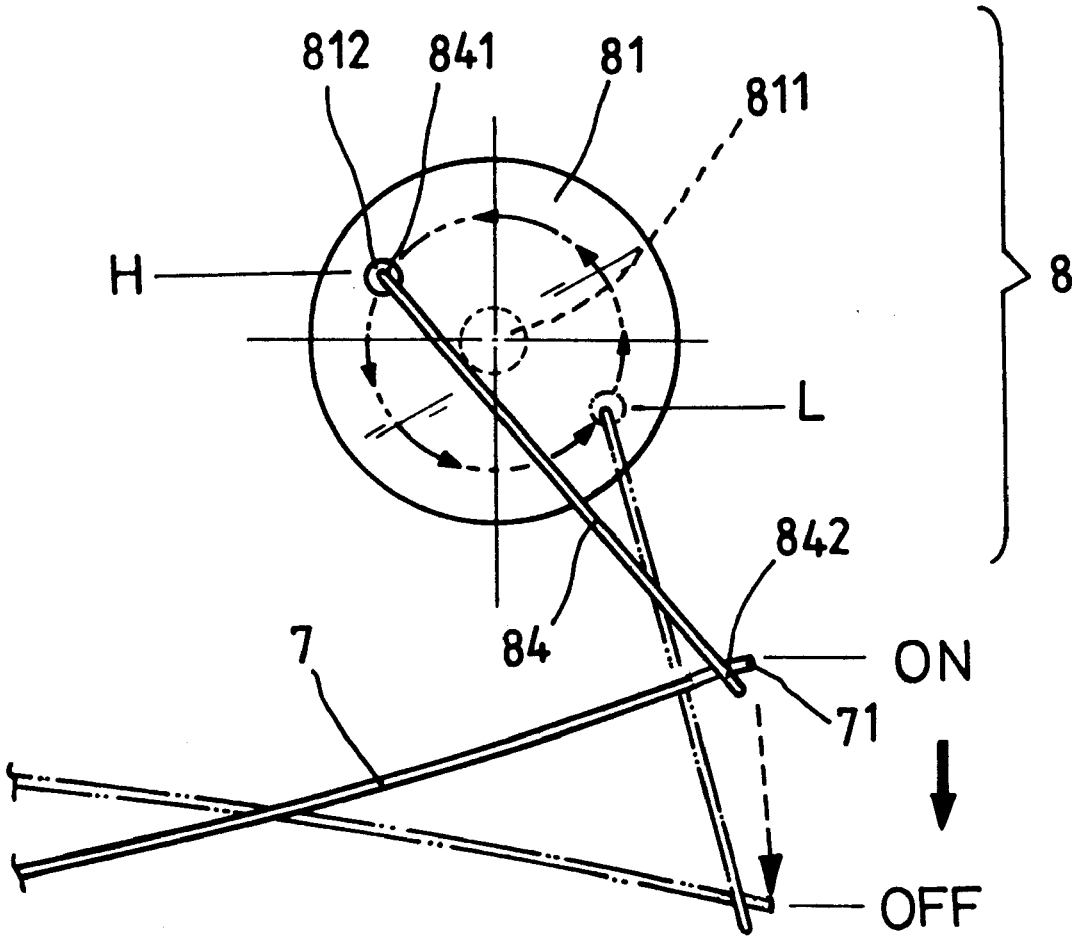
FIG. 9 is a schematic drawing of the rotary body of the present invention, showing the operation procedure thereof.

Referring to FIG. 9, the rotary body 81 is viewed from the front side of the present invention. When the eccentric hole 812 of the rotary body 81 rotates from the H-point downward to the L-point, the top arm 841 of the push-pull rod 84 is brought downward so that the position of the switching element 7 is changed by means that the bottom member 842 and the front projection 71 of the switching element 7 are connected. Accordingly, the on-off control of the switch is achieved.

Figure 1B:
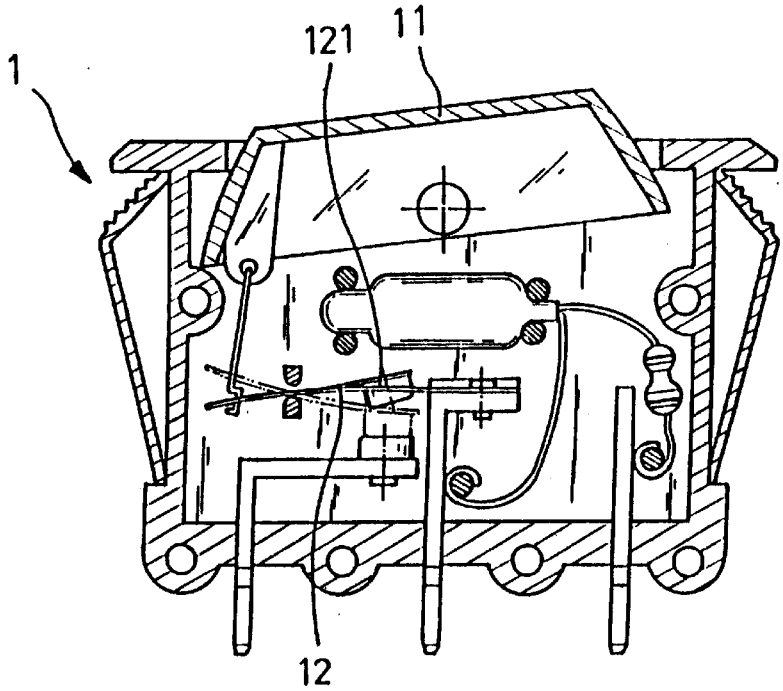
PRIOR ART FIG.1(B)
FIG. 1(B) is a sectional view of FIG. 1(A)
Figure 2A:
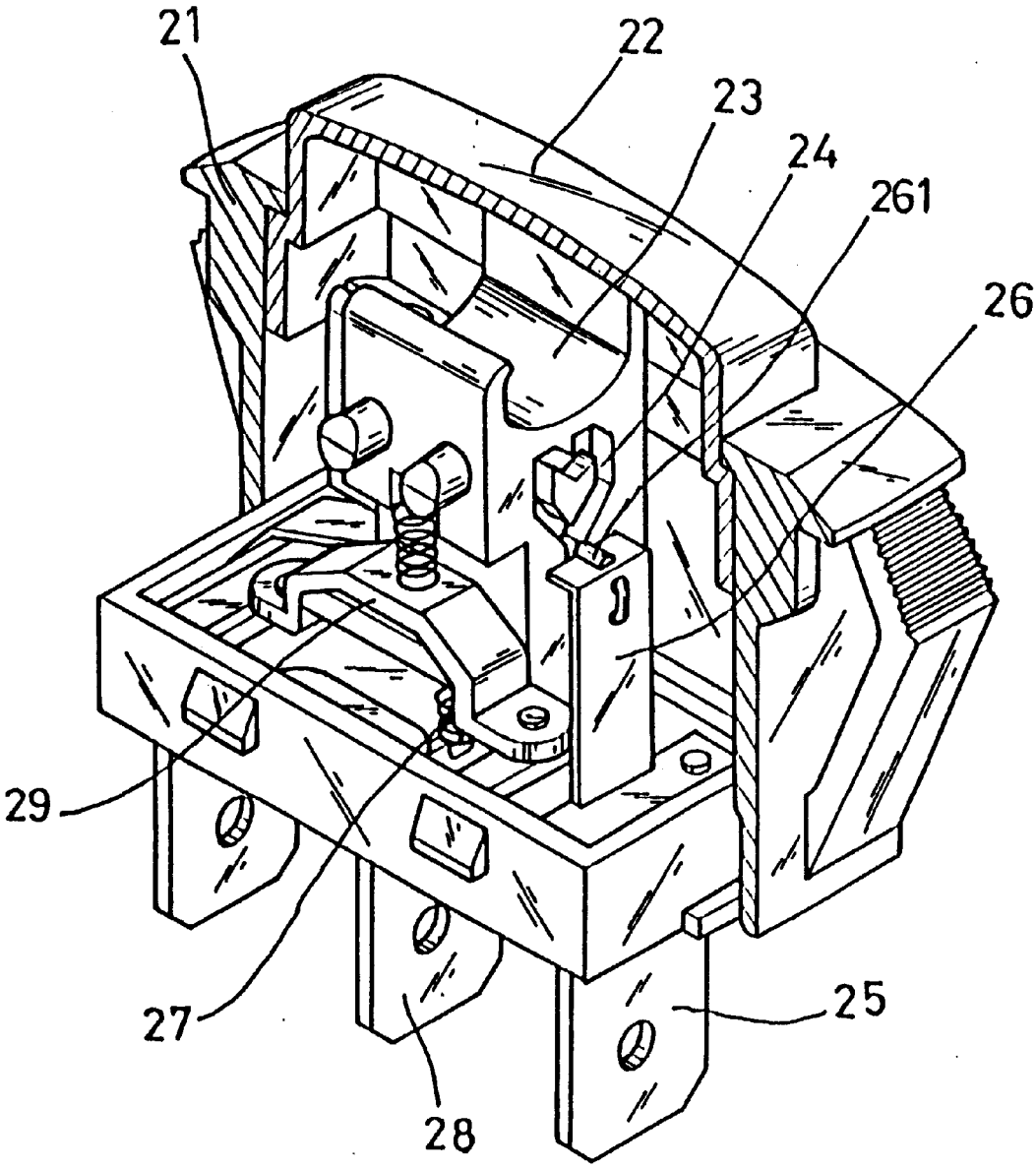
PRIOR ART FIG. 2(A)
FIG. 2(A) is a perspective sectional view of a conventional press-button switch.
Figure 2B:
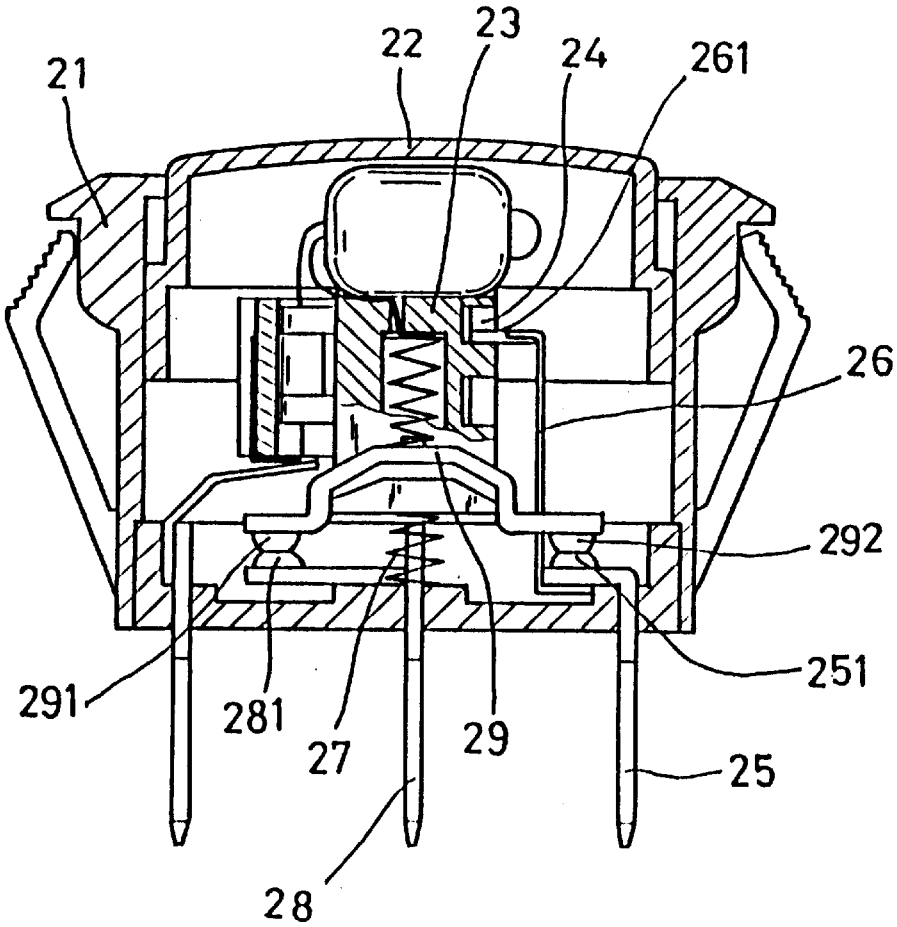
PRIOR ART FIG.2(B)
FIG. 2(B) is a section of FIG. 2(A)
Figure 10:
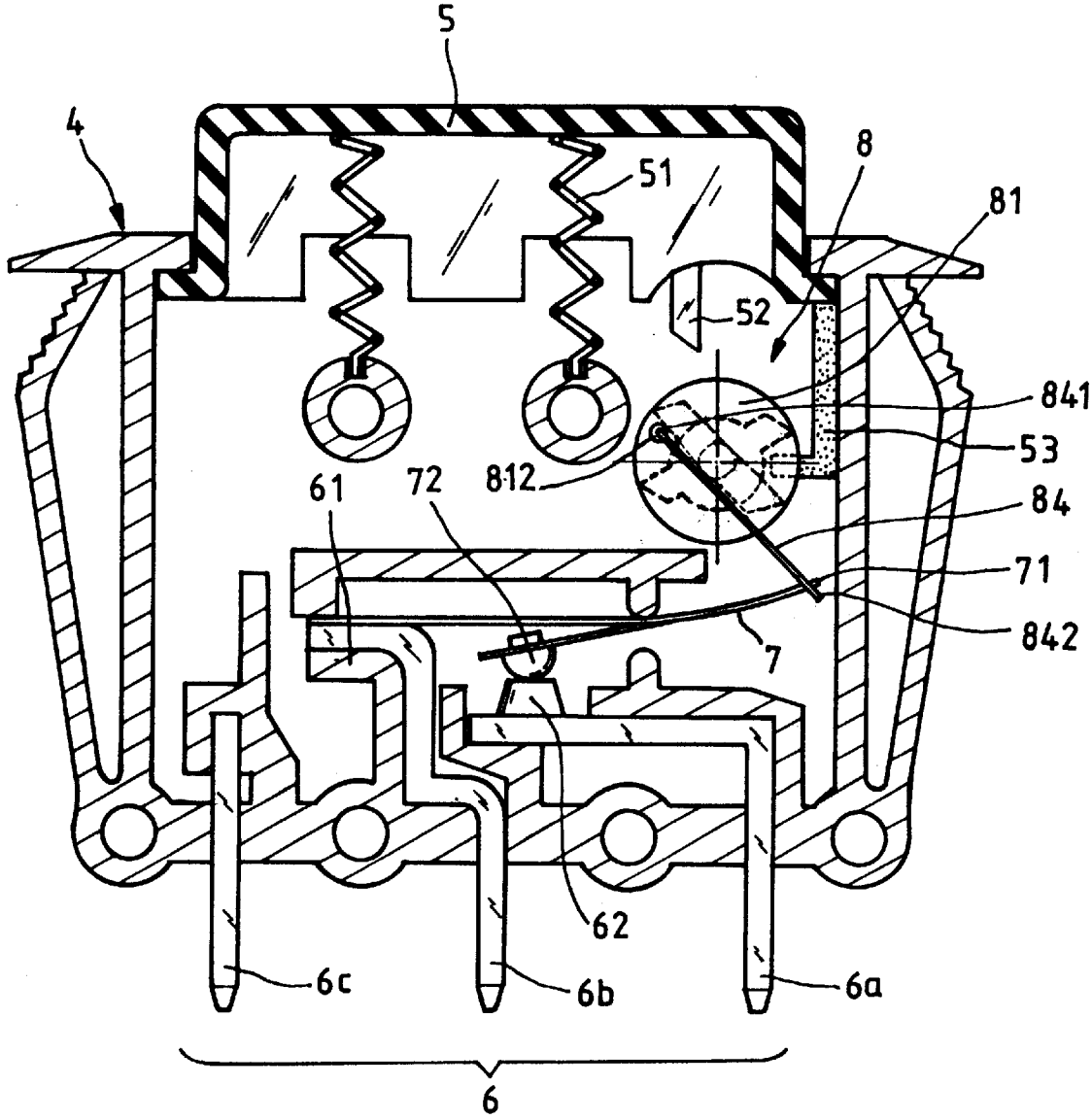
FIG. 10 is an applicable embodiment of the present invention, showing the switch in the on state.
Figure 11:
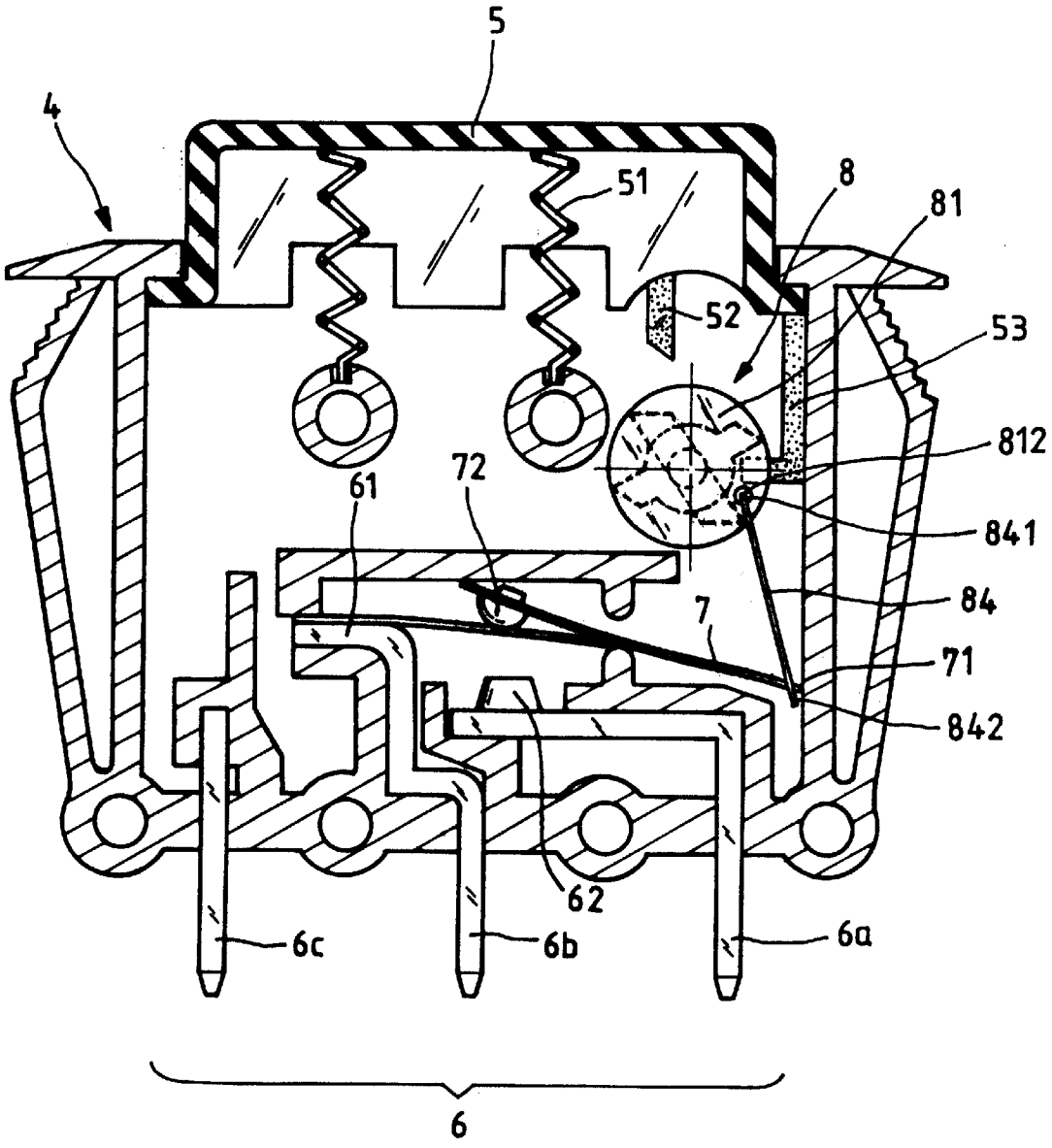
FIG. 11 is an applicable embodiment of the present invention, showing the switch in the off state.

Based upon the above-mentioned construction, the push element 52 and the hook member 53 of the press button 5 bring the rotary body 81 of the control unit 8 in a unidirectional rotation while the push-pull rod 84 eccentrically rotates therewith so that the on-off control is achieved by the displacement of the switching element 7. An applicable embodiment of the switching element 7 is shown in FIGS. 10 and 11. The control unit 8 is interposed between the press button 5 and the conducting switching element 7. FIG. 10 shows that the switching element 7 enables the first and second connecting terminals 6*a*, 6*b* in the on state. The third connecting terminal 6*c* is used for grounding. The embodiment of the switching element 7 is various. The switching element 7 used in the present invention is formed as the conducting strip shown in FIG. 1 which is disclosed in the Taiwanese Patent No. 320355. The rear end of switching element 7 is fixed onto the top member 61 of the second connecting terminal 6*b* while a connecting point 72 is arranged on the elastic piece in the middle of the switching element 7. When the front projection 71 of the switching element 7 is moved by the push-pull rod 84, the switching element 7 will change its position to enable the connecting point 72 to be in contact with a connecting point 62 of the first connecting terminal 6*a* in the on state or to be in disconnection therewith in the off state.

The displacement of the push-pull rod 84 is controlled by the rotary body 81 of the control unit 8. The rotary body 81 can approximately rotate at the angle of 180 degrees in compressing the press button 5 once while the top arm 841 of the push-pull rod 84 is driven to rotate by means of the eccentric hole 812. The rotational change has been described above in FIGS. 8 and 9. No further descriptions are given hereinafter. Consequently, the on-off control of the switch is achieved in pressing the press button 5 once, thereby forming a standard press-button switch.

The configuration of the present invention is very simple. The outline and the size of the housing 4 is almost the same to the conventional seesaw switch shown in FIG. 1(B) so that the application scope and the compatibility of the present invention is wide and excellent. In addition, the room of the inside of the housing 4 is fully used without influencing the position of other components. The most important is that the control unit 8 makes use of the push element 52 and the hook member 53 beneath the press button 5 to push and pull against the first and second actuating elements 82, 83, respectively so that the rotary body 81 of the control unit 8 can be switched between the upper point (H) and the lower point (L). Accordingly, the push-pull rod 84 can move the switching element 7 to perform the on-off control. Thus, the whole construction of the present invention is simple, the assembly is easy and the malfunction rate is low, thereby enhancing the quality of the press-button switch.

The present invention has not only the function of the conventional press-button switch; furthermore, the switch can be brought into off state in case of overload current.

Figure 12:
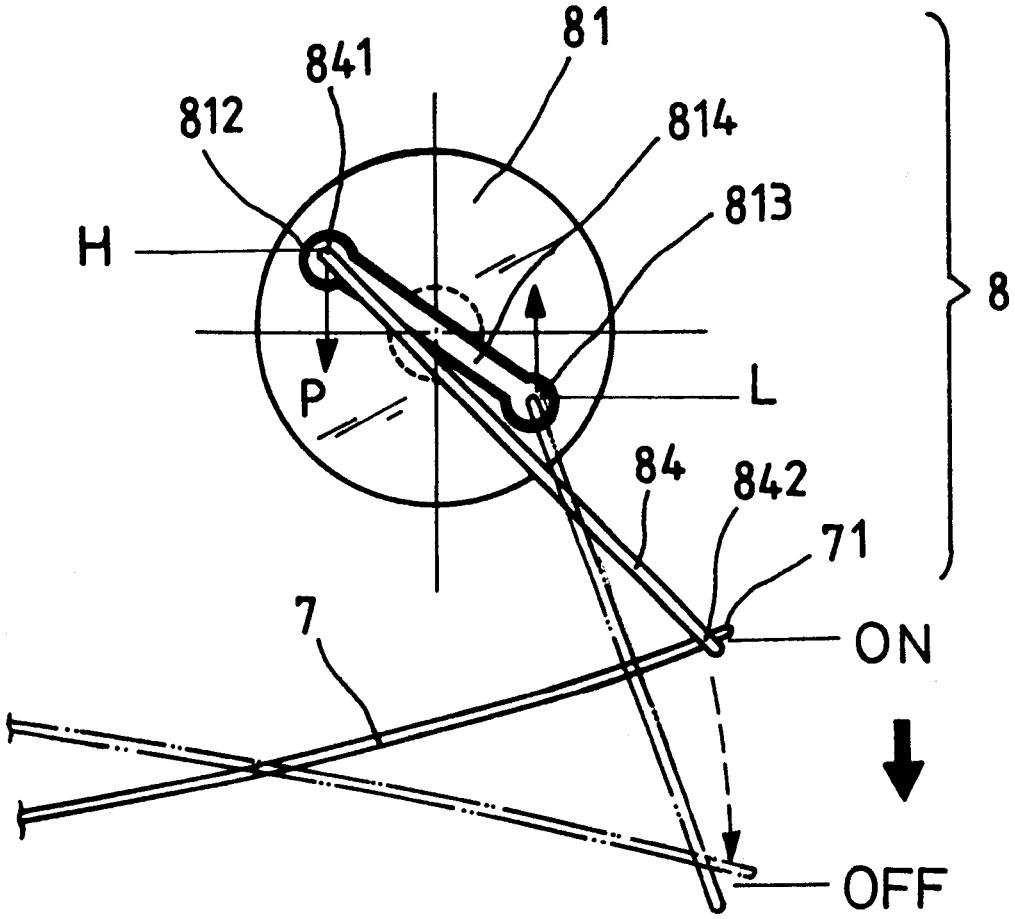
FIG. 12 is another applicable embodiment of the rotary body of the present invention.
Figure 13:
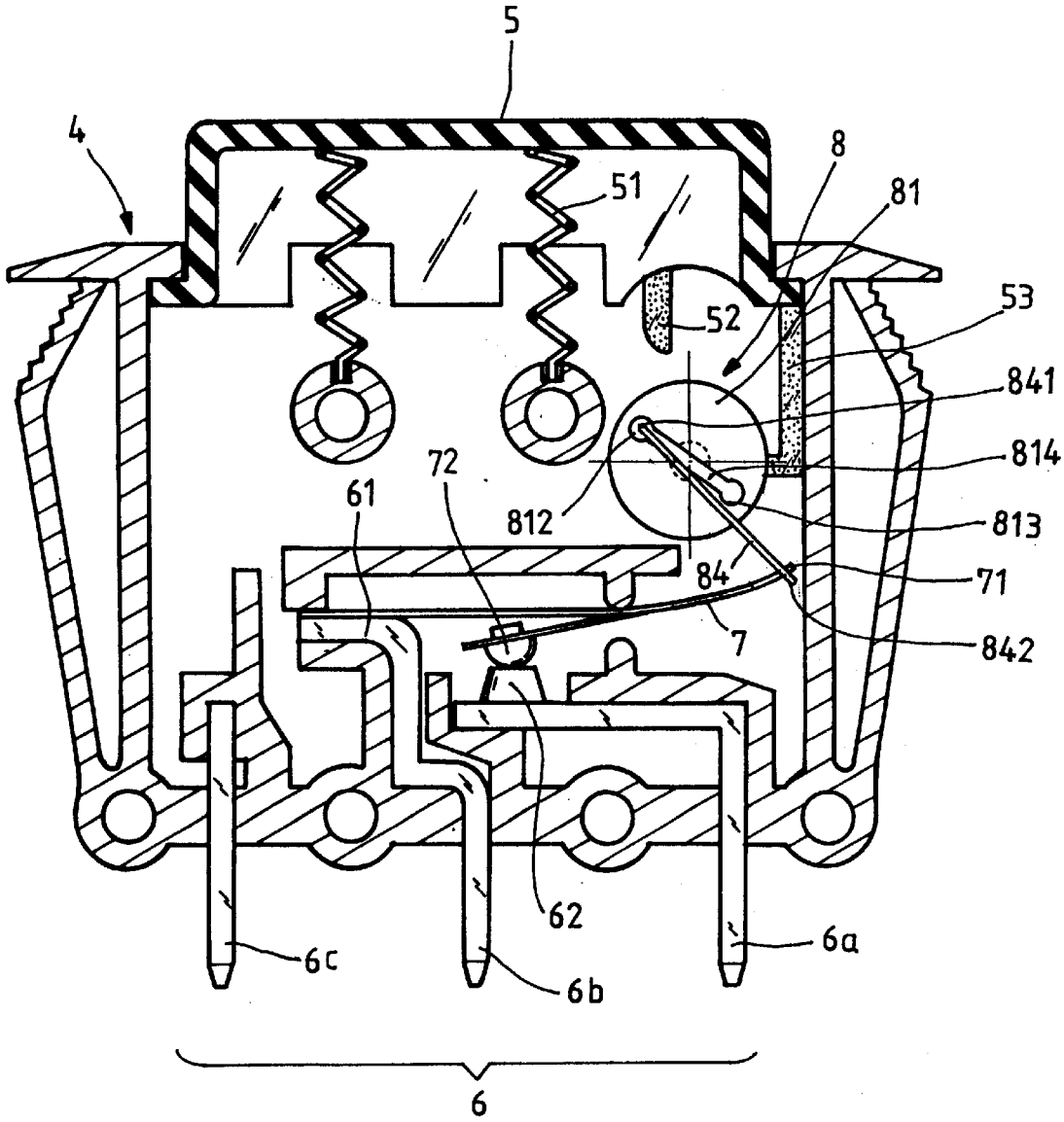
FIG. 13 is another applicable embodiment of the present invention, showing the switch in the on state.
Figure 14:
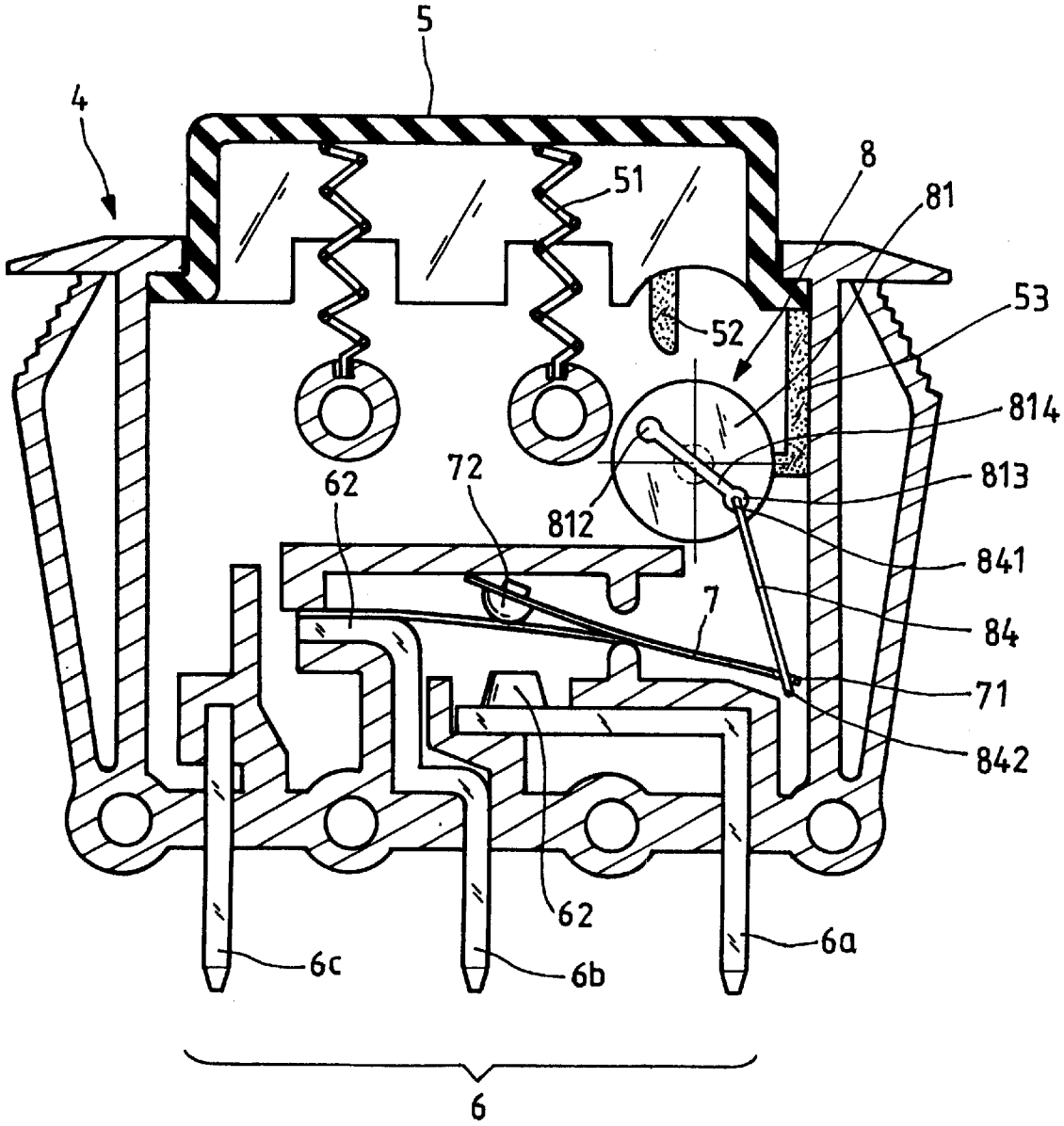
FIG. 14 is an applicable embodiment of the present invention, showing the switch in the off state.

FIG. 12 shows another embodiment of the rotary body 81 of the present invention. The opposing side of the eccentric hole 812 has a second eccentric hole 813 while a connecting groove 814 is provided between both eccentric holes 812, 813. In case of the overload current, the switching element 7 made from double alloy piece will automatically be moved in reverse direction and disconnected from the on state to the off state. Meanwhile, the front projection 71 of the switching element 7 will create a downward force to the bottom member 842 of the push-pull rod 84. If the rotary body 81 has no groove 814, the push-pull rod 84 won't be moved while the switching element 7 is tightly held by the push-pull rod 84, thereby leading to danger situation. The top arm 841 of the push-pull rod 84 can slide through the groove 814 from the eccentric hole 812 at the upper point (H) to the second eccentric hole 813 at the lower point (L) so that the switching element 7 is smoothly switched back to its original position in off state, thereby ensuring the electric safety. FIG. 13 shows that the switching element 7 is situated in on state while FIG. 14 shows that it is disconnected in off state. Moreover, the push-pull rod 84 is installed slightly above the groove 814 almost at the same slope so that it can smoothly slide from the upper point (H) to the lower point (L) in case of overload current. In order to understand the construction of the groove 814 better, it is specially marked in FIG. 12. In addition, the rotary body 81 utilizes the push or pull force of the eccentric hole 812 or 813 to move the push-pull rod 84. Though the groove 814 is existing between both eccentric holes 812 or 813, the driving force of the eccentric holes 812 or 813 is directed in the direction shown by the arrow (P) so that the groove 814 won't hinder the normal switching operation between on-off state in case of no current overload.

Accordingly, the press-button switch with the control unit 8 of the present invention can be used as conventional press-button switch. Besides, the rotary body 81 is provided with the second eccentric hole 813 and the connecting groove 814, thereby forming a safety switch which is disconnected in case of overload current. In comparison with the conventional press-button safety switch with complicated structure, the present invention can really reach the practical and safety effects.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A press-button switch comprising:

a housing formed in a hollow body and open at one side thereof, the open side of said housing being covered by a side plate, an opening being disposed at a top of said housing so that a press button is fitted thereinto, and resilient elements being provided for restoring said press button back to an original position;

connecting terminals fitted into said housing and arranged at a bottom thereof, a switching element being provided to perform an on-off control of said connecting terminals, a control unit installed within said housing and controlled by said press button to perform an on-off control of the switch by means of said switching element, wherein an improvement is characterized by:

said control unit having a rotary body and a push-pull rod;

said rotary body having a rotary shaft fitted into a through hole at an inner side of said housing so that said rotary body is located within said housing in rotatable state, said rotary body further having a first actuating element and a second actuating element both of which intersects in a cross shape, said second actuating element being interposed between said rotary body and said first actuating element, and said rotary body having an eccentric hole at an outside face thereof;

said push-pull rod having a top arm and a bottom member, said top arm being rotatably arranged in said eccentric hole of said rotary body while said bottom member is formed in U-shape and a front projection of said switching element is connected to an indentation of the bottom member;

said first and second actuating elements being controlled by a push element and a hook member both of which are coupled with said press button;

said push element disposed at a top of said first actuating element so that, when said press button is pressed downward, said first actuating element is pushed to turn the rotary body;

said hook member arranged to the side of said second actuating element so that, when said press button is raised back to the original position, said second actuating element will be pulled to enable said rotary body to continuously rotate in a turning direction driven by said first actuating element; and said rotary body rotating approximately at an angle of 180 degrees in pressing said press button once so that said eccentric hole moves said push-pull rod upwards or downwards in order for said switching element to perform the on-off control.

2. A press-button switch comprising:

a housing formed in a hollow body and open at one side thereof, the open side of said housing being covered by a side plate, an opening being disposed at a top of said housing so that a press button is fitted thereinto, and resilient elements being provided for restoring said press button back to an original position;

connecting terminals fitted into said housing and arranged at an bottom thereof, a switching element being provided to perform an on-off control of said connecting terminals;

a control unit installed within said housing and controlled by said press button to perform the on-off control of the switch by means of said switching element, wherein an improvement is characterized by:

said control unit having a rotary body and a push-pull rod;

said rotary body having a rotary shaft fitted into a through hole at an inner side of said housing so that said rotary body is located within said housing in rotatable state, said rotary body further having a first actuating element and a second actuating element both of which intersects in a cross shape, said second actuating element being interposed between said rotary body and said first actuating element, and said rotary body having two corresponding eccentric holes at an outside face thereof while a connecting groove is interposed between both eccentric holes;

said push-pull rod having a top arm and a bottom member, said top arm being rotatably arranged in a first of said eccentric holes of said rotary body while said bottom member is formed in U-shape and a front projection of said switching element is connected to an indentation of the bottom member;

said first and second actuating elements being controlled by a push element and a hook member both of which are coupled with said press button;

said push element disposed at a top of said first actuating element so that, when said press button is pressed downward, said first actuating element is pushed to turn the rotary body;

said hook member arranged to a side of said second actuating element so that, when said press button is raised back to the original position, said second actuating element will be pulled to enable said rotary body to continuously rotate in a turning direction driven by said first actuating element;

said rotary body rotating approximately at an angle of 180 degrees in pressing said press button once so that said first eccentric hole moves said push-pull rod upwards or downwards in order for said switching element to perform the on-off control; and said switching element being disconnected, responsive to said top arm of said push-pull rod passing through said connecting groove from said first eccentric hole to a second of said eccentric holes, in case of overload current.

* * * * *